US005875665A

United States Patent [19]

Yamamoto et al.

[11] Patent Number: 5,875,665

[45] Date of Patent: Mar. 2, 1999

[54] APPARATUS AND METHOD FOR BENDING A WORKPIECE

[75] Inventors: Masahiko Yamamoto, Kariya; Katsuyoshi Suzuki, Gamagori; Shigehide Ishikawa, Hoi-gun; Mineo Suzuki; Takumi Yamada, both of Hekinan; Youichi Harada, Chita-gun; Toshiyuki Miyagawa, Anjo; Daisuke Okuizumi, Kariya; Koichi Mikami, Chiryu, all of Japan

[73] Assignee: Aisin Seiki Kabushiki Kaisha, Kariya, Japan

[21] Appl. No.: 806,118

[22] Filed: Feb. 25, 1997

[30] Foreign Application Priority Data

Feb. 29, 1996 [JP] Japan ..... 8-042848
May 29, 1996 [JP] Japan ..... 8-135497

[51] Int. Cl.[6] ..... B21D 11/02

[52] U.S. Cl. ..... 72/21.1; 72/21.4; 72/297

[58] Field of Search ..... 72/296, 297, 303, 72/151, 153, 19.9, 21.4, 21.5, 19.2, 19.3, 16.6, 18.4, 21.1

[56] References Cited

U.S. PATENT DOCUMENTS 2,553,092 5/1951 Hubbert ..... 72/21.4
2,734,548 2/1956 Fredericks ..... 72/151
3,148,721 9/1964 Seavers ..... 72/151
3,302,437 2/1967 Dolney ..... 72/21.4
3,365,921 1/1968 Dolney ..... 72/18.4
4,048,826 9/1977 Lechner ..... 72/139

FOREIGN PATENT DOCUMENTS 61-159229 7/1986 Japan .
6-269861 9/1994 Japan .

*Primary Examiner*—Daniel C. Crane
*Attorney, Agent, or Firm*—Oblon, Spivak, McClelland, Maier & Neustadt, P.C.

[57] ABSTRACT

An apparatus for bending a workpiece comprises a stretching device for stretching the workpiece. In the process for bending the workpiece, an inclination angle made by a direction a tension force is acted to the workpiece and a direction a stretching forth is applied to the workpiece by the stretching member is detected. The tension force acted to the workpiece is controlled in such a manner that the stretching force from the stretching member is controlled in consideration of the inclination angle. Accordingly, the amount of the spring back after bending is uniform and an accuracy of the dimension of the bent workpiece is improved.

16 Claims, 11 Drawing Sheets

APPARATUS AND METHOD FOR BENDING A WORKPIECE

BACKGROUND OF THE INVENTION

1. Field of the Invention:

The present invention relates to an apparatus and method for bending a workpiece.

2. Description of the Related Art:

A technique for bending a workpiece is known from Japanese patent publication No. 6-269861, a main part of which is shown in FIG. 13. As shown in FIG. 13, a rotary table 1 is connected to a die 2. The rotary table 1 is rotatable around the vertical axis at a central point thereof. The die 2 is used to bend a workpiece W facing a surface of the die 2. A holding member 3 comprises a first holding member 31 and a second holding member 32. The first holding member 31 is fixed on the rotary table 1 and holds one end portion of the workpiece W. The second holding member 32 holds the other end portion of the workpiece W.

The rotary table 1 is connected to a rotary driver 4. The rotary driver 4 is used to rotate the rotary table 1 and bend the workpiece W in a horizontal direction. The second holding member 32 is connected a load cell 8 which is further connected to a twisting driver 9. The twisting driver 9 is used to apply a rotational force to the second holding member 32 and twist the workpiece W around an axis thereof. The twisting driver 9 is fixed on an up-down table 52 of an up-down driver 5. The up-down driver 5 is used to move the up-down table 52 in a vertical direction and bend the workpiece in the vertical direction. The up-down driver 5 is connected to a slide table 62 of a forward and backward driver 6. The forward and backward driver 6 is used to move the slide table 62 in the forward and backward direction and stretch the workpiece W by applying a stretching force thereto.

The die 2 has a side wall surface and an upper wall surface. The side wall surface and the upper wall surface are respectively formed to a desired arc.

The rotary driver 4, the up-down driver 5, the forward and backward driver 6, and the twisting driver 9 are electrically connected to and controlled by an NC controller 7 having a memory. Information detected by the load cell 8 is transmitted to a calculating device 82 and a result of the calculation based on the information of the load cell 8 is transmitted to the NC controller 7.

When an operation is started, each driver 4, 5, 6 is driven respectively according to a command signal outputted by the NC controller 7. The rotary table 1 is rotated by a driving force from the rotary driver 4 and the workpiece W is bent along the side wall surface of the die 2. The second holding member 32 is moved upward by a driving force from the up-down driver 5 and the workpiece W is bent along the upper wall surface of the die 2. Further, the second holding member 32 is rotated to twist the workpiece W by applying the driving force from the twisting driver.

In case of bending a stiff workpiece, it is necessary to bend the workpiece while applying a tension force to the workpiece to prevent the workpiece from being broken. For that reason, the second holding member 32 stretches the workpiece by applying a stretching force via the forward and backward driver 6.

Since each driver 4, 5, 6, 9 is operated as described above, the workpiece W is bent to form a desired shape.

According to this method of bending the workpiece, when the second holding member 32 is moved in the vertical direction (Y-axis direction shown in FIG. 13), the portion of the workpiece W held by the second holding member 32 is inclined relative to the horizontal direction (at X-axis direction shown in FIG. 14), which is the direction the workpiece is stretched by the forward and backward driver 6 in the vertical plane. Further, when the rotary table 1 is rotated, the portion of the workpiece W held by the second holding member 32 is inclined relative to the horizontal direction in the horizontal plane. Therefore, the direction of the tension force acting on the workpiece is different from the direction of the stretching force applied to the workpiece W by the forward and backward driver. Since the direction of the tension force is different from the direction of the stretching force, not all of the stretching force is transmitted to the workpiece as a tension force. Further, an inclination angle made by the direction of the tension force and the direction of the stretching force is variable in the bending process. Since the amount of spring back after bending is related to the tension force, an error in the dimension of the workpiece generated by the spring back after bending become larger.

SUMMARY OF THE INVENTION

The present invention has been developed in view of the above-described circumstances.

It is a primary object of the invention to provide a method and apparatus of bending a workpiece in which the error in dimension of the bent workpiece become smaller.

In order to achieve the above-mentioned objects, the present invention provides an apparatus for bending the workpiece, comprising a holding means for holding the workpiece and having a first holding member holding a part of the workpiece and a second holding member holding the other part of the workpiece, a die, a bending member for bending the workpiece by moving at least one of the first holding member or the second holding member relatively and facing the workpiece along the surface of the die, a stretching means for stretching the workpiece and a tension force control means for controlling the tension force applied to the workpiece.

According to the present invention, the tension force acting on the workpiece is controlled by the tension force control means. Therefore, the tension force acting on the workpiece can be uniform in the process of bending the workpiece so that any error in dimension of the bent workpiece becomes smaller.

BRIEF DESCRIPTION OF THE DRAWINGS

Additional objects and advantages of the present invention will become more apparent from the following detailed description of the preferred embodiments thereof when considered with reference to the attached drawings, in which.

DESCRIPTION OF THE PREFERRED EMBODIMENTS

Figure 1:
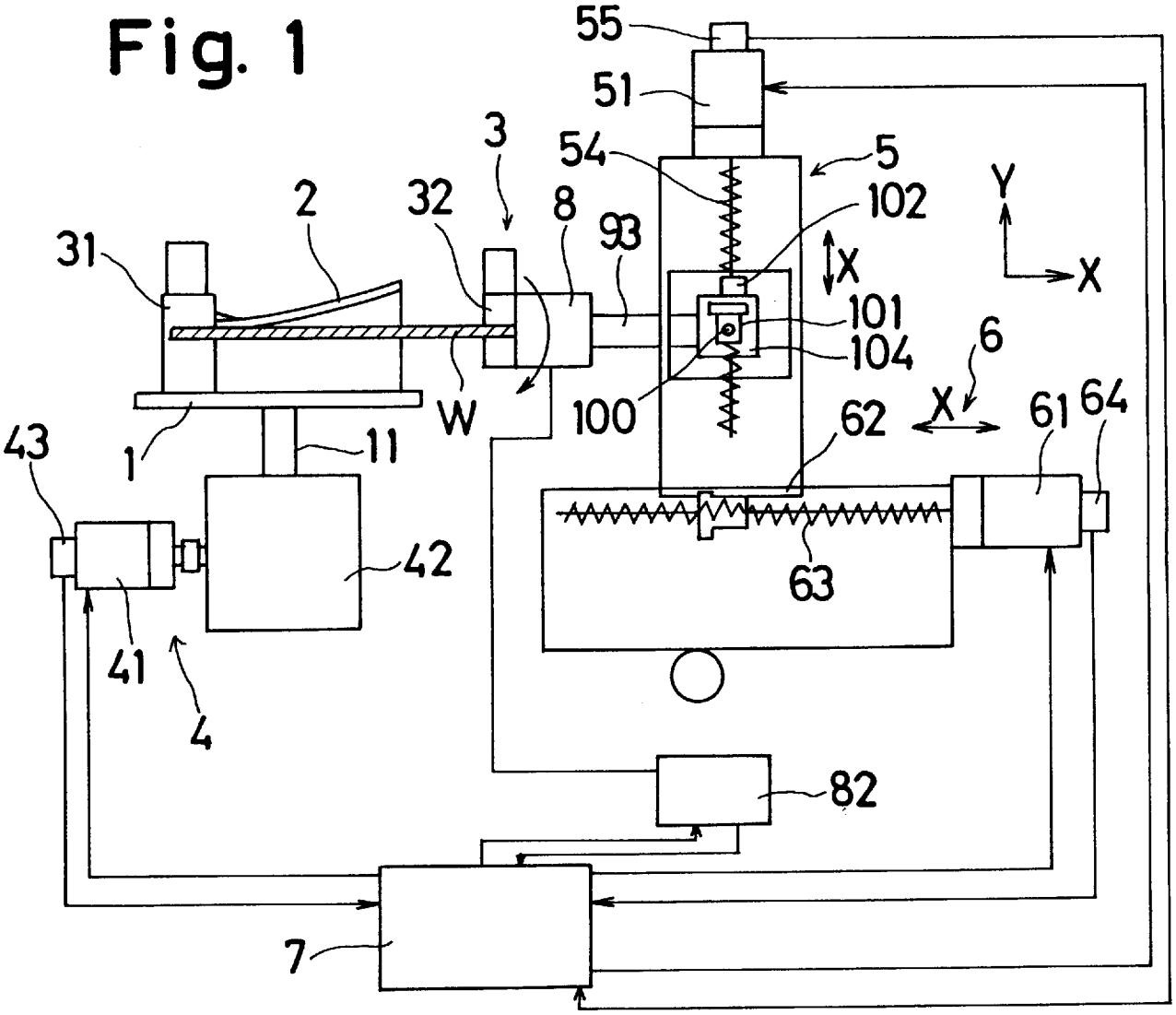
FIG. 1 is a schematic illustration of a bending apparatus of a first embodiment of the present invention.
Figure 2:
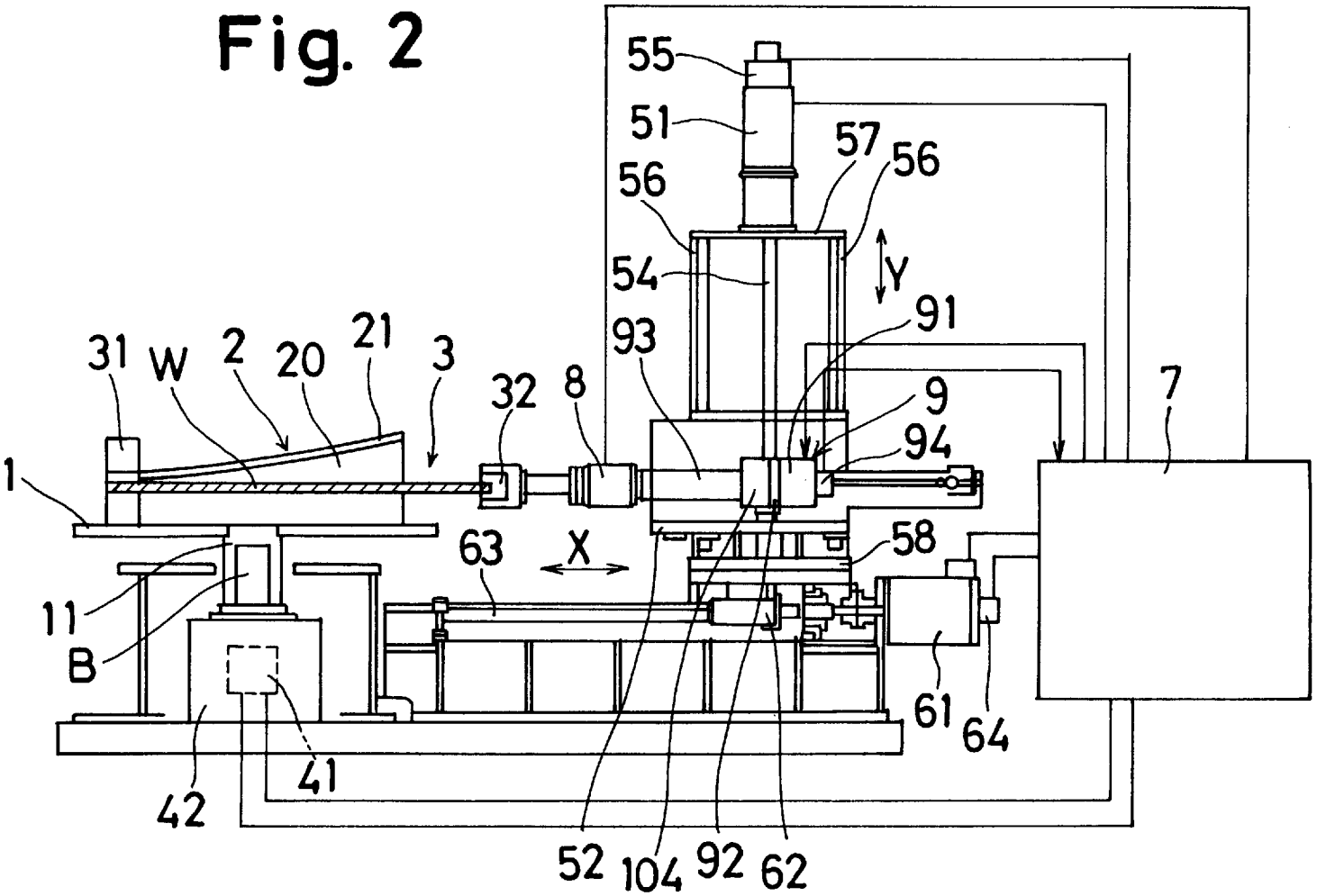
FIG. 2 is a front view of the bending apparatus of the first embodiment of the present invention.

FIG. 1 is a schematic illustration, and FIG. 2 is a front view, of a bending apparatus according to a first embodiment of the invention. In FIG. 1 and FIG. 2, a die 2 for bending a workpiece W is fixed on a rotary table 1. The rotary table 1 is rotatable around the vertical axis thereof. The workpiece W is held by a holding means 3 having a first holding member 31 and a second holding member 32. The first holding member 31 is fixed on the rotary table 1 and holds one end of the workpiece W. The second holding member 32 is spaced from the die 2 and holds the other end of the workpiece W.

The rotary table 1 is connected to a rotary table driver 4 having a speed reducer 42 and a servo motor 41. An output shaft 11 of the speed reducer 42 is connected to the rotary table 1 at a central position of the rotary table 1 and an input shaft of the speed reducer 42 is connected to the servo motor 41.

The second holding member 32 is connected to a load cell 8. The load cell 8 is further connected to one end portion of a connecting rod 93. The other end portion of the connecting rod 93 is connected to a twisting driver 9 having a servo motor 91 and a speed reducer 92. The connecting rod 93 is connected to the speed reducer 92 and an input shaft (not shown) of the speed reducer 92 is connected to the servo motor 91.

Figure 3:
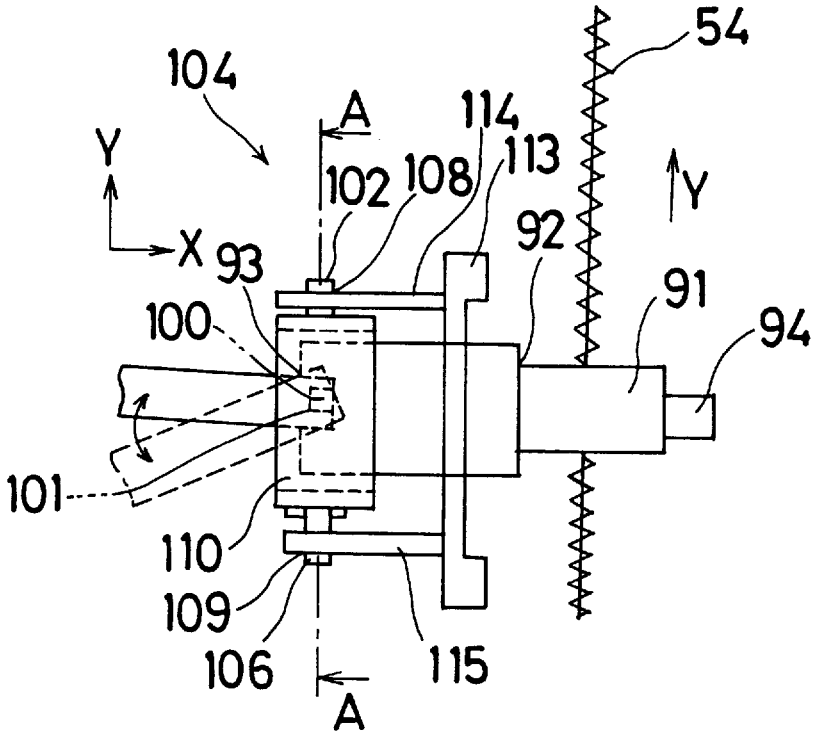
FIG. 3 is an enlarged detail of a moving member of the bending apparatus of the first embodiment of the present invention.
Figure 4:
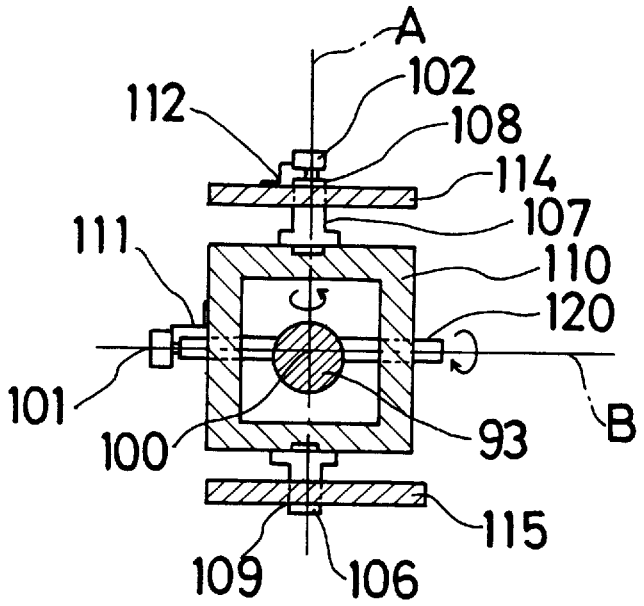
FIG. 4 is a cross-sectional view taken on line A—A of FIG. 3.

The connecting rod 93 is attached to moving member 104. A detailed view of the moving member 104 is shown in FIGS. 3 and 4. FIG. 3 is an enlarged view of the moving member 104 and FIG. 4 is a cross-sectional view taken on line A—A in FIG. 3. As shown in FIG. 3 and FIG. 4, the moving member 104, which is disposed around the connecting rod 93, has a fixed member 113, an upper flange 114, a lower flange 15, an upper shaft 107, a lower shaft 106, a horizontal shaft 120, and a housing member 110. The upper flange 114 and the lower flange 115 are connected to the fixed member 113. The upper flange 14 has a hole 108, and the lower flange 115 has a hole 109. As shown in FIG. 4, the upper shaft 107 penetrates the hole 108 and the lower shaft 106 penetrates the hole 109.

The housing member 110 is formed with a hollow rectangular cross section and has an upper wall, a lower wall and side walls. One end portion of the upper shaft 107 is connected to the upper wall of the housing member 110. One end portion of the lower shaft 106 is connected to the lower wall of the housing member 110. The housing member 110 is rotatable around an axis shown at A in FIG. 4. The horizontal shaft 120 penetrates the housing member 110 in the horizontal direction. The connecting rod 93 is fixed with the horizontal shaft 120. The horizontal shaft 120 is rotatable around an axis shown at B in FIG. 5. Since the moving member 104 is constituted as explained above, the connecting rod 93 is rotatable around the axis shown at A with the housing member 110 and is rotatable around the axis shown at B by the horizontal shaft 120.

Figure 6:
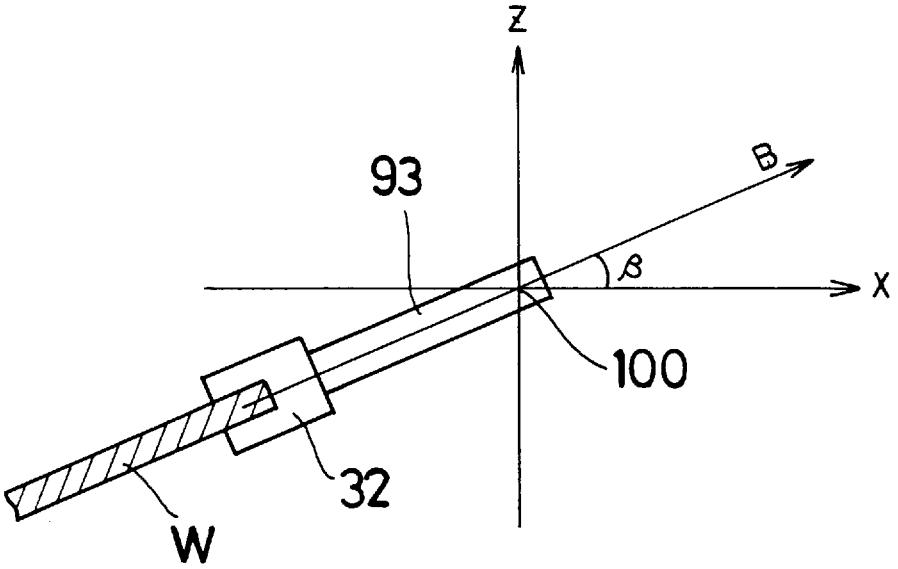
FIG. 6 is an enlarged view of a connecting rod which is inclined relative to the horizontal axis (x-axis) in a horizontal plane (x-z plane) of the first embodiment of the present invention.

A first angle detection sensor 102 detects an inclination angle $\beta$ between an x-axis direction and a direction of inclination B of the connecting rod 93 in the horizontal plane (x-z plane) (FIG. 6). The x-axis direction is the direction of the stretching force applied to the workpiece W and the direction of axis B is the direction of the tension force applied to the workpiece W in the horizontal plane. Therefore, the inclination angle $\beta$ is the angle made by the direction of the tension force acting on the workpiece W and the direction the stretching force applied to the workpiece by the forward and backward driver 6 in the horizontal plane.

Figure 5:
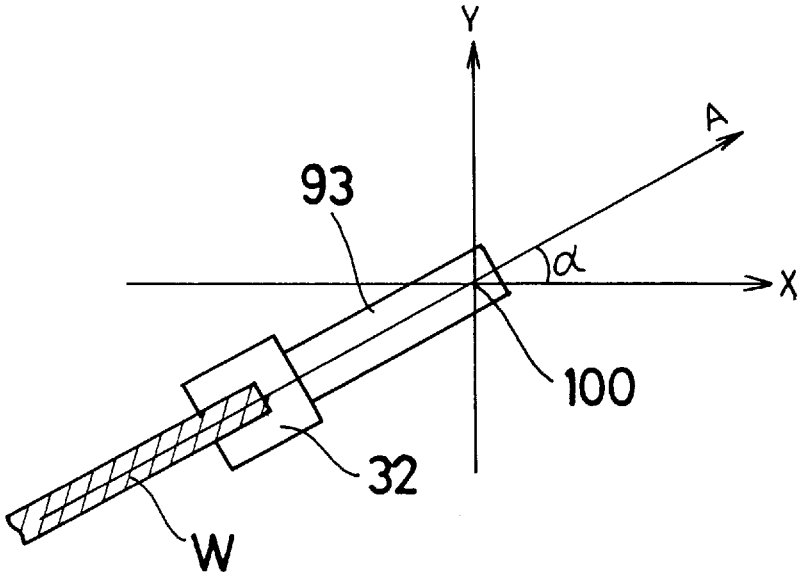
FIG. 5 is an enlarged view of a connecting rod which is inclined relative to a horizontal axis (x-axis) in a vertical plane (x-y plane) of the first embodiment of the present invention.

The first angle detection sensor 102 is connected to the other end portion of the upper shaft 107 and supported by a bracket 112 fixed on the upper flange 114. A second angle detection sensor 101 is used for detecting an angle $\alpha$ made by the x-axis and the inclination axis A of the connecting rod 93 in the vertical plane (x-y plane)(FIG. 5). The x-axis direction is the same direction as the stretching force applied to the workpiece W, and the direction of axis A is the same direction as the tension force applied to the workpiece W in the vertical plane. Therefore, the inclination angle $\alpha$ is the same as that made by the tension force acting on the workpiece W and the stretching force applied to the workpiece by the forward-and-backward driver 6 in the vertical plane. The second angle detection sensor 101 is connected to one end portion of the horizontal shaft 120 and supported by a bracket 111 fixed on the side wall of the housing member 110. A variable resistor is used for the sensor 101 and 102 in this embodiment.

In FIG. 1 and FIG. 2, an up-down driver 5 used for bending the workpiece W in the vertical direction has a servo motor 51, an up-down table 52, a screw shaft 54, an encoder 55, a guide rail 56, an upper plate member 57 and a lower plate member 58. As shown in FIG. 2, the moving member 104 is fixed on the up-down table 52. The guide rail 56 is disposed between the upper plate member 57 and the lower plate member 58 along the vertical direction. The up-down table 52 is engaged with the screw shaft 54 and is movable vertically along the guide rail 56 when the screw shaft 54 rotates. One end portion of the screw shaft 54 is connected to an output shaft (not shown) of the servo motor 51.

A forward-and-backward driver 6 has a servo motor 61 fixed on a machine bed, an engaging member 62, a screw shaft 63 connected to the servo motor 61 and an encoder 64. The lower plate 58 is engaged with the engaging member 62, which is also engaged with the screw shaft 63.

The die 2 has a side wall surface 20 and an upper wall surface 21. The side wall surface 20 and the upper wall surface 21 are respectively formed to a desired arc.

Figure 8:
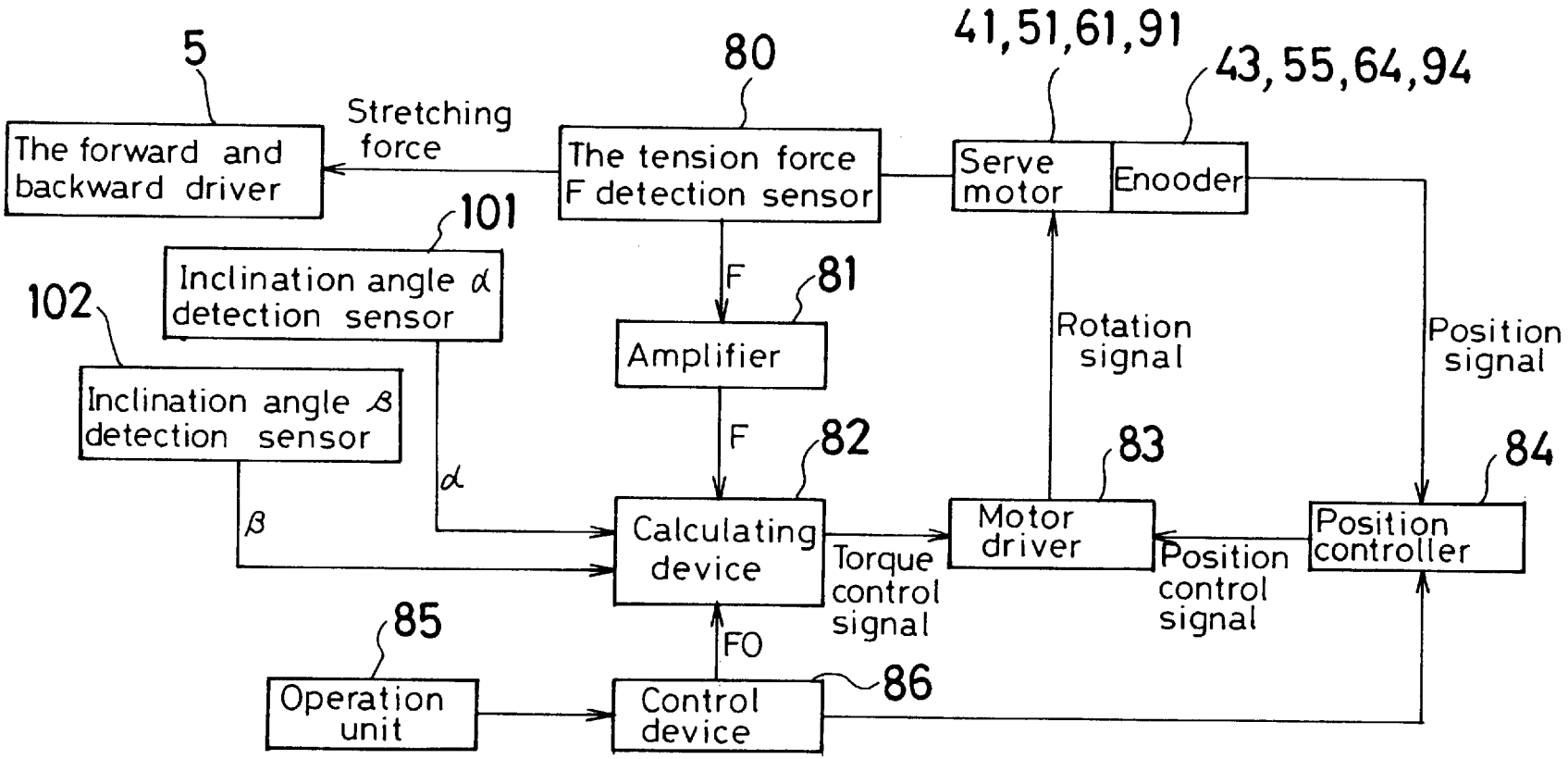
FIG. 8 is a block diagram showing a control of the bending apparatus of the first embodiment of the present invention.

Each servo motor 41, 51, 61, 91 is connected to an encoder 43, 55, 64, 94 respectively. These servo motors 41, 51, 61, 91, and encoders 43, 55, 64, 94 are electrically connected to an NC controller 7 is used for controlling movement of each servo motor 41, 51, 61, 91 based on position data from each servo motor and stored in a memory. The position data of each servo motor is inputted to the NC controller by an operating unit 85 as shown in FIG. 8.

An operation of the bending apparatus is explained as follows. First the workpiece W is set on the die 2. The first holding member 31 holds the workpiece W at one end thereof and the second holding member 32 holds the other end of the workpiece W. Then a control signal from the NC controller is transmitted to each servo motor.

When the output shaft of the servo motor 41 rotates according to the control signal from the NC controller, the rotation is transmitted to the speed reducer 42. In the speed reducer 42, the rotational speed is reduced and transmitted to the rotary table 1 to rotate the same. Since the rotary table 1 rotates, the die 2 fixed on the rotary table 1 also rotates. Therefore, the first holding member 31 which holds one end portion of the workpiece W, moves relative to the second holding member which holds the other end portion of the workpiece W. Accordingly, the workpiece W is bent in the horizontal plane along the side wall surface 20 of the die 2.

When the output shaft of the servo motor 51 rotates in response to a control signal from the NC controller 7, the rotation is transmitted to the screw shaft 54. Since the up-down table 52 is engaged with the screw shaft 54, the up-down table 52 is moved in the vertical direction. Since the up-down table 52 moves, the moving member 104 fixed on the up-down table 52, the connecting rod 93 connected to the horizontal shaft 120 of the moving member 104, the load cell 8 connected to the connecting rod 93, and the second holding member 32 connected to the load cell 8 all move in the vertical direction. Therefore, the second holding member 32 which holds the other end portion of the workpiece W, moves relative to the first holding member 31 which holds one end portion of the workpiece W. Accordingly, the workpiece W is bent in the vertical plane along the upper surface 21 of the die 2.

When the output shaft of the servo motor 91 rotates in response to a control signal from the NC controller 7, the rotation is transmitted to the speed reducer 92. The reduced rotational speed is transmitted to the connecting rod 93. Since the connecting rod 93 is rotated, the load cell 8 connected to the connecting rod 93, and the second holding member 32 connected to the load cell 8 are rotated integrally, so that the workpiece W held by the second holding member 32 is twisted.

Figure 7:
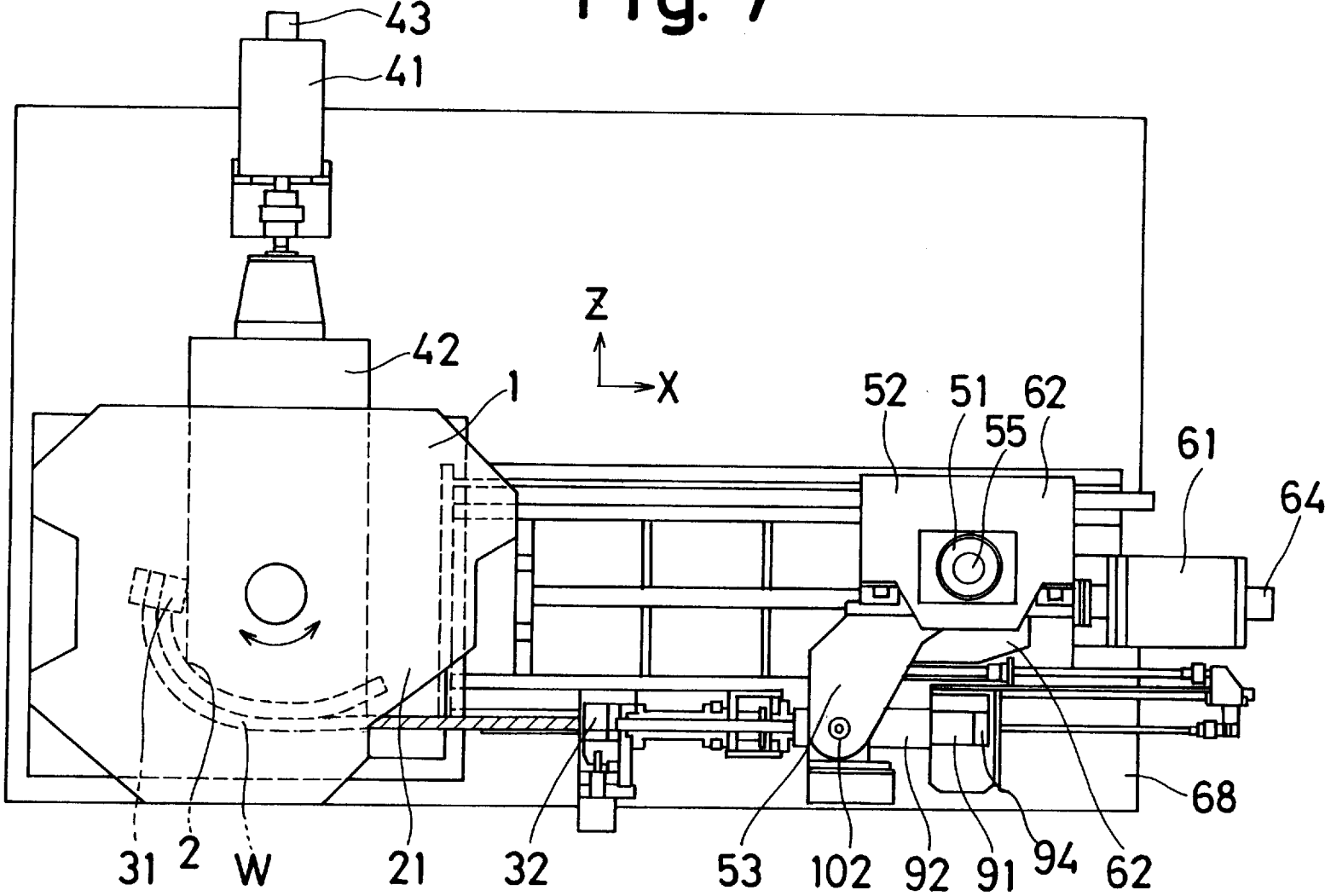
FIG. 7 is plan view of the bending apparatus of the first embodiment of the present invention.

When the output shaft of the servo motor 61 rotates in response to a control signal from the NC controller 7, the rotation is transmitted to the screw shaft 63 connected to the servo motor 61. Since the engaging member 62 is engaged with the screw shaft 63, a driving force in the backward direction is applied to the engaging member and transmitted to the up-down driver 5 connected to the engaging member 62, the moving member 104 fixed on the up-down table 52 of the up-down driver 5, the connecting rod 93 connected to the moving member 104, load cell 8 connected to the connecting rod 93 and the second holding member 32 connected to load cell 8. Accordingly, the workpiece W held by the second holding member 32 is stretched in the backward direction and the stretching force in the horizontal direction (x-axis direction shown in FIG. 7) is applied to the workpiece W.

As shown in FIG. 8, the tension force acting on the workpiece W is detected by a tension force detecting sensor 80 in the load cell 8. A tension force signal is output from the tension force detecting sensor 80 to a calculating device 82 via an amplifier 81 by which the tension force signal is amplified. In the calculating device 82, the tension force detected by the tension force detecting sensor 80 is compared with a preset tension force and a torque control signal based on a difference between the two is output to a motor driver 83.

Each encoder 43, 55, 64, 94 of each servo motor 41, 51, 61, 91 outputs a position signal to a position controller 84 which outputs position control signals to the motor driver 83. The motor driver 83 outputs rotation control signals based on the position control signals from the position controller 84 and torque control signals from the calculating device 82 to each servo motor. The workpiece W is thus bent.

Figure 9:
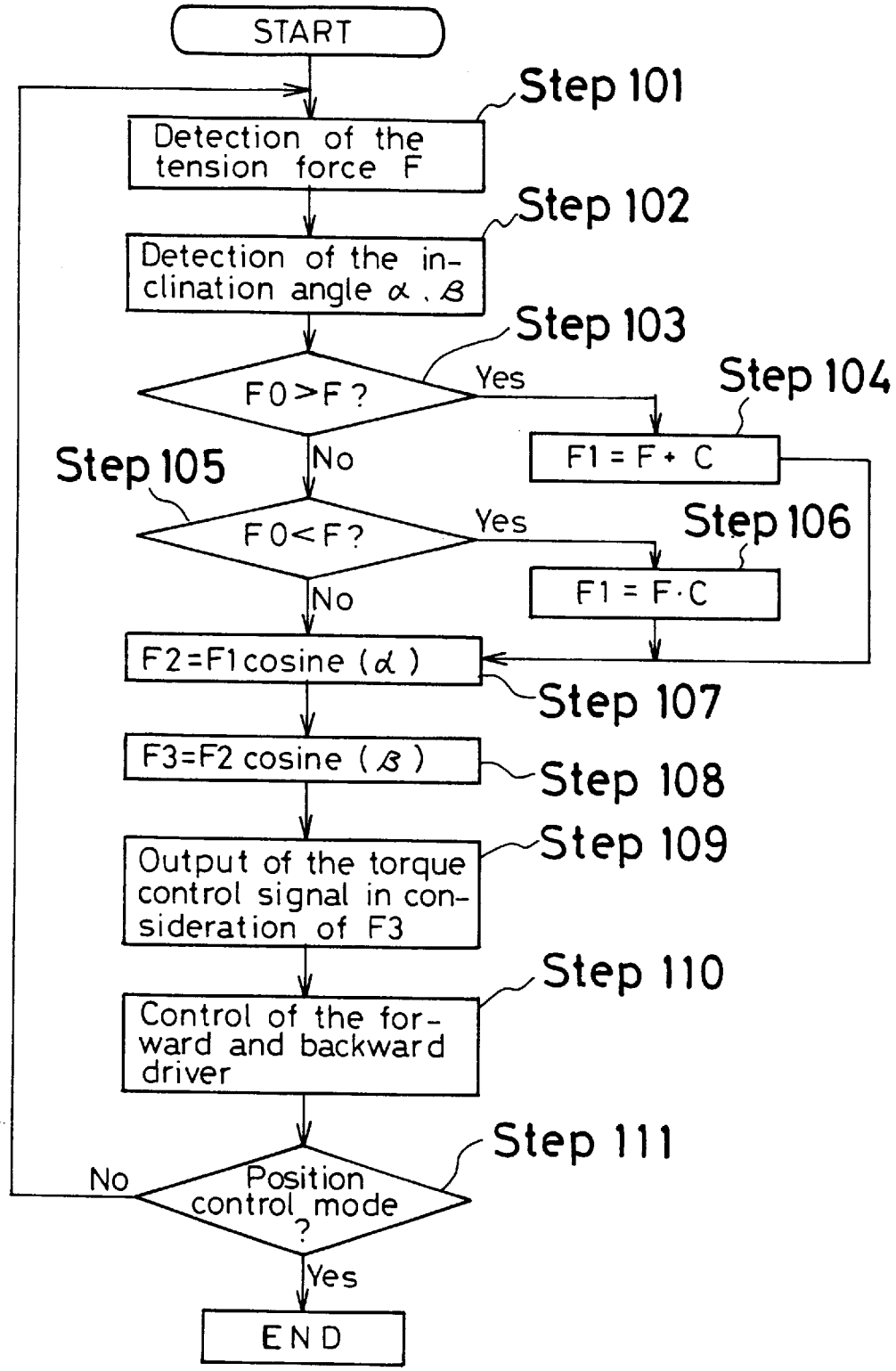
FIG. 9 is a flowchart showing an operation of the torque control of the bending apparatus of the first embodiment of the present invention.

FIG. 9 is a program in the calculating device 82 for controlling the tension force. In step 101 the tension force is detected by the tension detecting sensor 80. In step 102 the inclination angle $\beta$ in the horizontal plane and the inclination angle $\alpha$ in the vertical plane are detected by the sensors 101 and 102. In step 103 a value of the tension force F detected by the tension force detector 80 is compared with a value of the tension force F0 set up and memorized previously. If the value of the tension force F0 is larger than the value of the tension force F, the program proceeds to step 104. In step 104, a first tension force F1 is set to a value F+C which is larger than the value of the tension force F.

In step 103, if the value of the tension force F0 is smaller than the value of the tension force F, the program proceeds to step 105. In step 105, a value of the tension force F is compared with a value of the tension force F0. If the value of the tension force F0 is smaller than the value of the tension force F, the program proceeds to step 106. In step 106, a first tension force F1 is set to a value F−C which is smaller than the value of the tension force F.

In step 105, if the value of the tension force F0 is larger than the value of the tension force F, the program proceeds to step 107. In step 107, a second tension force F2 is set to the first tension force F1 multiplied by cosine ($\alpha$) (F2=F1 cosine($\alpha$)). In step 108, a third tension force F3 is set to the second tension force F2 multiplied by cos $\beta$ (F3=F2 cosine ($\beta$)). In step 109, a torque control signal in consideration of the third tension force F3 is output to the motor driver 83. And in step 110 the forward-and-backward driver 6 is controlled so that a determined torque is output and the third tension force is applied to the workpiece W. In step 111, it is judged whether position control mode is in a process. If position control mode is not in a process, the program returns to step 101. If position control mode is in a process, the program goes to end.

As explained above, the inclination angle $\alpha$ in the horizontal plane and the inclination angle $\beta$ in the vertical plane are detected and tension force applied to the workpiece W is controlled in such a manner that the output torque from the servo motor 61 of the forward-and-backward driver 6 is controlled in consideration of the inclination angle $\alpha$ and the inclination angle $\beta$. Accordingly, the amount of spring back after bending is uniform and a dimensional error of the bent workpiece becomes smaller.

SECOND EMBODIMENT

Figure 10:
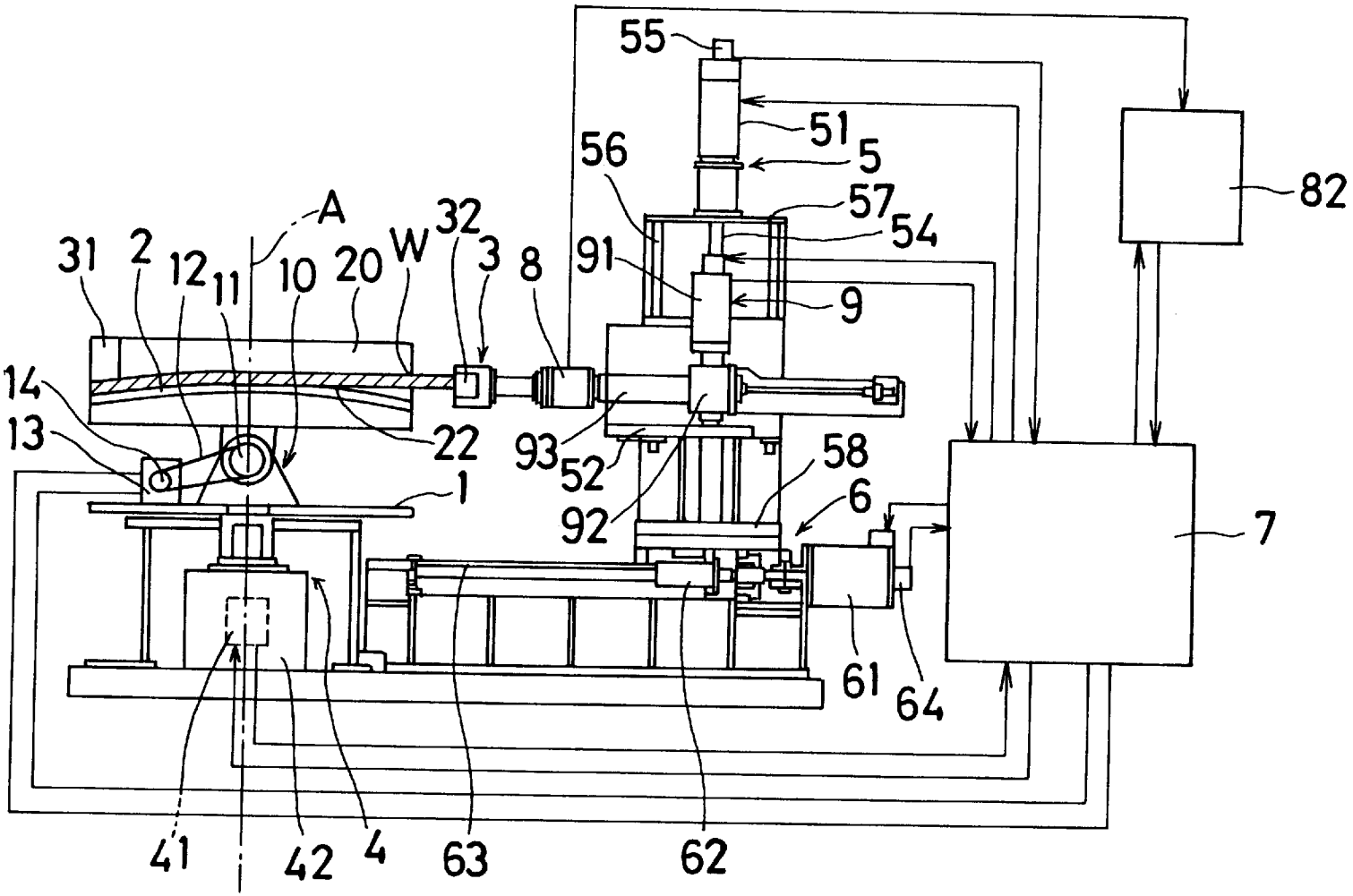
FIG. 10 is a front view of the bending apparatus of the second embodiment of the present invention.

FIG. 10 is a front view of a bending apparatus of a second preferred embodiment of the invention.

In FIG. 10, a die inclination driver 10 is on a rotary table 1. The rotary table 1 is rotatable around the vertical axis as shown at A in FIG. 10. The workpiece W is held by a holding means 3 having a first holding member 31 and a second holding member 32. The first holding member 31 is fixed on a die 2 and holds one end portion of the workpiece W. The second holding member 32 is spaced from the die 2 and holds the other end portion of the workpiece W. The rotary table 1 is connected to a rotary table driver 4 including a speed reducer 42 and a servo motor 41. An output shaft of the speed reducer 42 is connected to the rotary table 1 at a central position thereof and an input shaft 45 of the speed reducer 42 is connected to the servo motor 41.

The second holding member 32 is connected to a load cell 8. The load cell 8 is further connected to one end portion of a connecting rod 93. The other end portion of the connecting rod 93 is connected to a twisting driver 9. The twisting driver 9 is used to twist the workpiece W and has a servo motor 91 and a speed reducer 92. The connecting rod 93 is connected to the speed reducer 92 and an input rod (not shown) of the speed reducer 92 is connected to the servo motor 91.

In FIG. 10, an up-down driver 5 has a servo motor 51, an up-down table 52, a screw shaft 54, an encoder 55, a guide rail 56, an upper plate member 57 and a lower plate member 58. The speed reducer 92 is fixed on the up-down table 52. The guide rail 56 is disposed between the upper plate member 57 and the lower plate member 58 along the vertical direction. The up-down table 52 is engaged with the screw shaft 54 and is movable in the vertical direction along the guide rail 56 when the screw shaft 54 rotates. One end portion of the screw shaft 54 is connected to an output shaft (not shown) of the servo motor 51.

A forward-and-backward driver 6 has a servo motor 61 fixed on a machine bed, an engaging member 62, a screw shaft 63, and an encoder 64. The lower plate 58 is engaged with the engaging member 62. The engaging member 62 is also engaged with the screw shaft 63. One end portion of the screw shaft 63 is connected to the servo motor 61.

The die 2 is fixed on the die inclination driver 10. The die inclination driver 10 has a first pulley 11, a belt 12, a servo motor 13, a second pulley 14, and an encoder 15. The first pulley 11 is connected to the second pulley 14 via the belt 12. The second pulley 14 is connected to the servo motor 13. The servo motor 13 is electrically connected to the NC controller 7.

The die 2 has a side wall surface 20 and a lower wall surface 22. The side wall surface 20 and the lower wall surface 22 are respectively formed in a desired arc.

Each servo motor 13, 41, 51, 61, 91 is connected to an encoder 15, 43, 55, 64, 94 respectively. These servo motors 13, 41, 51, 61, 91, and encoders 15, 43, 55, 64, 94 are electrically connected to the NC controller 7 for controlling movement of each servo motor 13, 41, 51, 61, 91 based on memorized position data of each servo motor. The position data of each servo motor is inputted to the NC controller 7 by operating an operating unit.

A value of the tension force detected by the load cell 8 is transmitted to a calculating device 82, and the calculating device 82 outputs a control signal based on the value of the tension force to the NC controller 7.

An operation of the bending apparatus is explained as follows. The workpiece W is first set on the die 2, and the first holding member 31 holds the workpiece W at one end portion thereof and the second holding member 32 holds the other end portion thereof. Then a control signal from the NC controller is transmitted to each servo motor.

When the output shaft of the servo motor 41 rotates according to the control signal from the NC controller 7, the rotation is transmitted to the speed reducer 42 in which the rotational speed is decreased and rotational direction is changed. The reduced speed rotation is transmitted to the rotary table 1 via the output shaft of the speed reducer 42 and the rotary table 1 is rotated. Since the rotary table 1 rotates, the die 2 fixed on the rotary table 1 also rotates. Therefore, the first holding member 31, which holds one end portion of the workpiece W, moves relative to the second holding member which holds the other end portion of the workpiece W. Accordingly, the workpiece W is bent in the horizontal plane along the side wall surface 20 of the die 2.

When the output shaft of the servo motor 51 rotates based on the control signal from the NC controller 7, the rotation is transmitted to the screw shaft 54. Since the up-down table 52 is engaged with the screw shaft 54, it is moved in the vertical direction, which integrally moves the speed reducer 92 fixed on the up-down table 52, the connecting rod 93 connected to the speed reducer 92, the load cell 8 connected to the connecting rod 93 and the second holding member 32 connected to the load cell 8. Therefore, the second holding member 32 which holds the other end portion of the workpiece W, moves relative to the first holding member 31 which holds one end portion of the workpiece W. Accordingly, the workpiece W is bent in the vertical plane along the lower surface 22 of the die 2.

When the output shaft of the servo motor 91 rotates based upon the control signal from the NC controller 7, the rotation is transmitted to the speed reducer 92. The reduced rotational speed is transmitted to the connecting rod 93. Since the connecting rod 93 is rotated, the load cell 8 connected to the connecting rod 93 and the second holding member 32 connected to the load cell 8 are rotated integrally, so that the workpiece W held by the second holding member 32 is twisted.

When the output shaft of the servo motor 61 rotates based on the control signal from the NC controller 7, the rotation is transmitted to the screw shaft 63 connected to the servo motor 61. Since the engaging member 62 is engaged with the screw shaft 63, a driving force in the backward direction is applied to the engaging member 62 and is transmitted to the up-down driver 5 connected to the engaging member 62, the speed reducer 92 fixed on the up-down table 52 of the up-down driver 5, the connecting rod 93 connected to the speed reducer 92, load cell 8 connected to the connecting rod 93 and the second holding member 32 connected to the load cell 8. Accordingly, the workpiece W held by the second holding member 32 is stretched in the backward direction and a stretching force in the horizontal direction is applied to the workpiece W which is bent.

Figure 11:
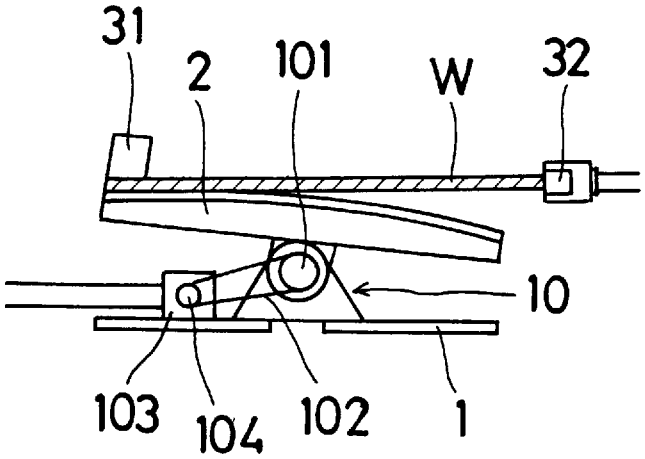
FIG. 11 is a segmentary view of a die inclination driver showing the die inclination driver at a starting point of a bending process.
Figure 12:
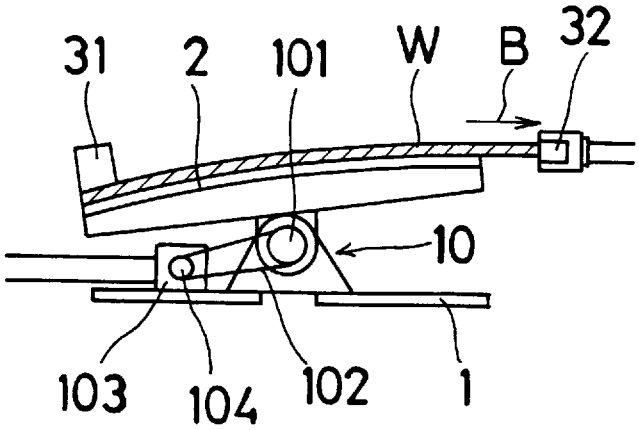
FIG. 12 is a segmentary view of the die inclination driver, showing it in the bending process.
Figure 13:
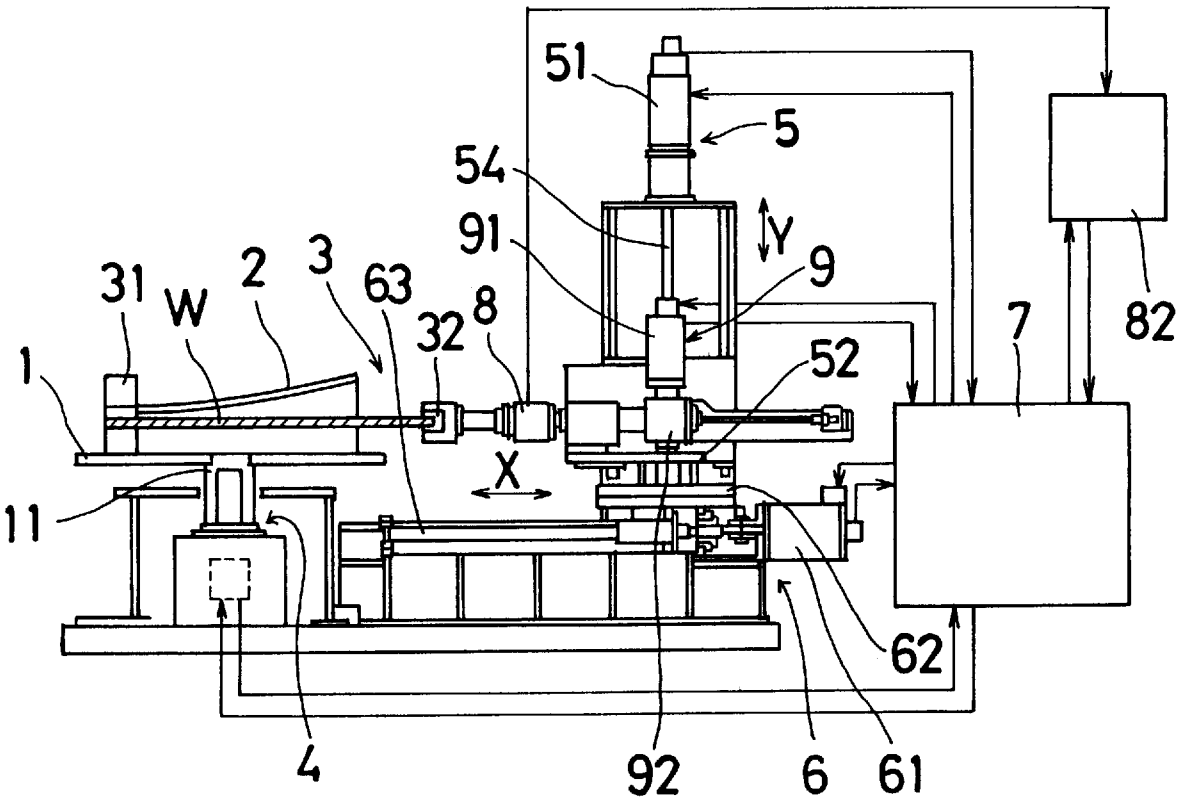
Fig. 13 (Prior Art)
FIG. 13 is a front view of a conventional bending apparatus.
Figure 14:
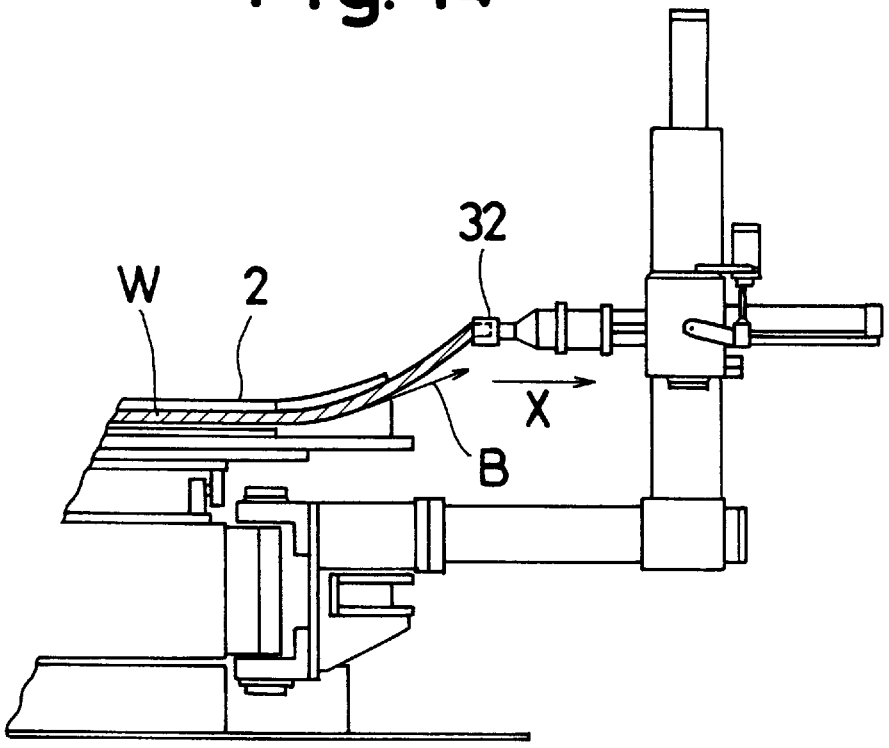
FIG. 14 is a detailed view showing a direction a tension force is acted to the workpiece and a direction a stretching force is applied to the workpiece by a stretching driver.

The die 2 is inclined by the die inclination driver 10 in the bending process. At the starting point, the rotation of the servo motor 13 is controlled by the NC controller 7. The rotation of the servo motor 13 is transmitted to the second pulley 14, the belt 12, and the first pulley 11. The rotation force is applied from the first pulley 11 to the die 2 connected to the first pulley 11, and the die 2 is inclined as shown in FIG. 11. In the state of FIG. 11, a direction of the force acting on the workpiece W by the forward-and-backward driver 6 and a direction of the tension force acting on the workpiece W are the same. While the bending process proceeds, the die 2 is inclined as shown in FIG. 12 by controlling the die inclination driver 10 based on position data of each servo motor. In the state of FIG. 12, a direction of the force acting on the workpiece W by the forward-and-backward driver 6 and a direction of the tension force acting on the workpiece W is the same.

As explained above, the tension force applied to the workpiece W is controlled to be the same as that which the forward-and-backward driver 6 applies to the workpiece W in such a manner that the die inclination driver 10, as a tension force control means, is a compensating member which makes the direction of the force applied to the workpiece by the forward-and-backward driver 6 coincide with the direction that the tension force acts on the workpiece W. Accordingly, the amount of spring back after bending is uniform and errors in the dimension of the bent workpiece W become smaller.

Obviously, numerous modifications and variations of the present invention are possible in light of the above teachings. It is therefore to be understood that the invention may be practiced otherwise than as specifically described herein.

What is claimed as new and desired to be secured by Letters Patent of the United States is:

1. An apparatus for bending a workpiece, comprising:

holding means for holding the workpiece, said holding means having a first holding member holding a part of the workpiece and a second holding member holding an other part of the workpiece;

a die having a surface formed to desired shape;

bending means for bending the workpiece by moving at least one of said first holding member and said second holding member such that the workpiece is bent along the surface of said die;

stretching means for stretching the workpiece in a direction to produce a tension force therein; and tension force control means for controlling the tension force, wherein said tension force control means includes a compensating member for making a direction of tension force coincide with a direction of stretching force wherein said compensating member comprises a die inclination means for inclining said die so as to make the direction of the stretching force applied to the workpiece by said stretching means coincide with the direction of the tension force.

2. An apparatus for bending a workpiece as set forth in claim 1, wherein said die inclination means inclines said die in a vertical plane.

3. An apparatus for bending a workpiece as set forth in claim 2, wherein said bending means comprises a rotational driver for rotating said die around a vertical axis to bend the workpiece along the surface of said die in the horizontal plane.

4. An apparatus for bending the workpiece as set forth in claim 3, wherein said stretching means comprises a forward-and-backward driver for applying the stretching force to the workpiece in the horizontal direction.

5. A method for bending a workpiece comprising the steps of:

a first holding step for holding a part of the workpiece by a first holding member;

a second holding step for holding the other part of the workpiece by a second holding member;

a bending step for bending the workpiece by moving at least one of said first holding member and said second holding member such that the workpiece is bent along the surface of said die;

a stretching step for stretching the workpiece in a direction to produce a tension force therein;

a controlling step for controlling the tension force, wherein said tension force control step includes a compensating step for making a direction of tension force coincide with a direction of stretching force, wherein said compensating step comprises a die inclining step for inclining said die during said bending step so as to make the direction of the stretching force applied to the workpiece coincide with the direction of the tension force.

6. A method for bending a workpiece as set forth in claim 5, wherein said die inclines in a vertical plane.

7. An apparatus for bending a workpiece, comprising:

holding means for holding the workpiece, said holding means having a first holding member holding a part of the workpiece and a second holding member holding an other part of the workpiece;

a die having a surface formed to desired shape;

bending means for bending the workpiece by moving at least one of said first holding member and said second holding member such that the workpiece is bent along the surface of said die;

stretching means for stretching the workpiece in a direction to produce a tension force therein; and tension force control means for controlling the tension force, wherein said tension force control means comprises detecting means for detecting an inclination angle between a direction of the tension force and a direction of the stretching force applied by said stretching means, and means for controlling the stretching force based on the inclination angle.

8. An apparatus for bending a workpiece as set forth in claim 7, wherein said detecting means comprises a first detector for detecting the inclination angle in a horizontal plane.

9. An apparatus for bending a workpiece as set force in claim 8, wherein said detecting means further comprises a second detector for detecting the inclination angle in a vertical plane.

10. An apparatus for bending a workpiece as set forth in claim 8, wherein said bending means comprises a rotational driver for rotating said die around a vertical axis to bend the workpiece along the surface of said die in the horizontal plane.

11. An apparatus for bending a workpiece as set forth in claim 9, wherein said bending means comprises an up-down driver for moving said second holding member and the workpiece in the vertical direction to bend the workpiece along the surface of said die in the vertical plane.

12. An apparatus for bending a workpiece as set forth in claim 11, wherein said stretching means comprises a forward-and-backward driver for applying a stretching force to the workpiece in the horizontal direction.

13. An apparatus for bending a workpiece as set forth in claim 12, wherein said forward-and-backward driver comprises a servo motor having a controllable output torque.

14. An apparatus for bending a workpiece as set forth in claim 13, wherein said tension force control means controls the output torque of said servo motor based on said inclination angle.

15. A method for bending a workpiece comprising the steps of:

a first holding step for holding a part of the workpiece by a first holding member;

a second holding step for holding the other part of the workpiece by a second holding member;

a bending step for bending the workpiece by moving at least one of said first holding member and said second holding member such that the workpiece is bent along the surface of said die;

a stretching step for stretching the workpiece in a direction to produce a tension force therein;

a controlling step for controlling the tension force, wherein said controlling step comprises a detecting step for detecting an inclination angle between a direction of the tension force and a direction of the stretching force applied by said stretching means, and a step of controlling the stretching force based on the inclination angle.

16. A method for bending a workpiece as set forth in claim 15, wherein said detecting step comprises a first detecting step for detecting the inclination angle in a horizontal plane, and a second detecting step for detecting the inclination angle in a vertical plane.

* * * * *